US011852349B2

(12) United States Patent
Woodall et al.

(10) Patent No.: US 11,852,349 B2
(45) Date of Patent: Dec. 26, 2023

(54) CONVECTION HEATING ELEMENT

(71) Applicant: Electrolux Home Products, Inc., Charlotte, NC (US)

(72) Inventors: Mikel Woodall, Cedar Hill, TN (US); Gregory Funk, Nashville, TN (US); Ryan Blanchard, Davidson, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 122 days.

(21) Appl. No.: 17/198,711

(22) Filed: Mar. 11, 2021

(65) Prior Publication Data

US 2022/0290873 A1 Sep. 15, 2022

(51) Int. Cl.
*F24C 15/32* (2006.01)
*F24C 7/06* (2006.01)

(52) U.S. Cl.
CPC ..... *F24C 15/325* (2013.01); *F24C 7/067* (2013.01)

(58) Field of Classification Search
CPC ..... F24C 15/325; F24C 7/067
See application file for complete search history.

(56) References Cited

U.S. PATENT DOCUMENTS

| | | | | |
|---|---|---|---|---|
| 4,283,614 | A | 8/1981 | Tanaka et al. | |
| 6,872,926 | B1 | 3/2005 | Arntz et al. | |
| 7,015,443 | B2 | 3/2006 | Whipple, Jr. | |
| 7,910,861 | B2 | 3/2011 | Nam et al. | |
| 9,372,005 | B2 | 6/2016 | Raghavan et al. | |
| 2010/0006085 | A1* | 1/2010 | Thomas | F24C 15/325 165/104.34 |
| 2017/0280516 | A1 | 9/2017 | Jung et al. | |
| 2018/0220498 | A1 | 8/2018 | Jeon et al. | |
| 2019/0120500 | A1 | 4/2019 | Kim et al. | |
| 2020/0011539 | A1* | 1/2020 | Mayberry | F24C 15/327 |

FOREIGN PATENT DOCUMENTS

| | | |
|---|---|---|
| EP | 1559959 | 8/2005 |
| EP | 2060854 | 5/2009 |
| WO | 2002039021 | 5/2002 |

OTHER PUBLICATIONS

Ring heating Heating element Heating convection heating Hot air heating 2000W 230V Baking oven Stove for Amica 8001785 8026766. First review date: Jan. 11, 2020. Luth Premium Profi Parts.

* cited by examiner

*Primary Examiner* — Thien S Tran
(74) *Attorney, Agent, or Firm* — Pearne & Gordon LLP

(57) ABSTRACT

A convection oven includes a heating element made of a single coil formed into a pair of concentric loops. The concentric loops are disposed in parallel planes to improve the thermal efficiency and power requirements of the convection oven.

10 Claims, 2 Drawing Sheets

CONVECTION HEATING ELEMENT

FIELD OF THE INVENTION

The present invention relates to a heating element for a convection oven, and more particularly to a convection heating element including a pair of concentric loops that are disposed in parallel planes and spaced relative to one another to define both an axial gap and an radial/lateral gap therebetween.

BACKGROUND OF THE INVENTION

Convection ovens generally include a cavity with a fan and one or more heating elements located adjacent to (typically surrounding) the fan. The heating element(s) and fan can be disposed behind a shroud that is mounted to a rear wall of the cavity. When operating the oven, the fan blows air over the heating element to heat the air as it is expelled into the cavity through air-passage openings formed in the shroud. The heating element generally is made of an electrical-resistant coil that converts electrical energy into heat. Some convection ovens utilize two distinct heating elements or coils for generating heat. However, such designs require a higher watt density (e.g., power per sq. in.) for attaining a requisite heat setting, thereby compromising the thermal efficiency of the oven. A higher watt density generally requires the use of larger diameter coils, which decreases the available amount of cooking space in the oven.

The thermal efficiency of many convection ovens is also limited based on an inadequate transfer of heat from the heating element to the air blown over the heating elements. For instance, a conventional heating element design obstructs air from flowing over an entirety of the heating element, thereby diminishing the amount of heat that is transferred to the air blown into the cavity. This may result in the rear wall of the cavity and the shroud absorbing more heat than is desirable, thereby causing rear wall and the shroud to reach temperatures more susceptible to thermal cracking of enamel coated thereon.

Therefore, it is desirable to have a low-profile heating element design that improves the thermal efficiency of the oven by increasing the amount of heat that may be transferred from the heating element to the air blown into the cavity.

SUMMARY OF THE INVENTION

There is provided a heating element for a convection oven. The heating element includes a first loop and a second loop arranged concentrically relative to a common axis and defining a lateral gap therebetween when viewed along said axis. The first loop is disposed in a first plane and the second loop is disposed in a second plane axially spaced relative to the first plane to define an axial gap between the first loop and the second loop.

There is also provided a convection oven including a cavity defining a cooking space. A fan is mounted adjacent to a rear wall of the cavity, and a convection heating element is mounted adjacent to the rear wall and disposed around the fan. The convection heating element includes a coil having a first loop and a second loop arranged concentrically relative to a common axis to define a lateral gap therebetween. The first loop is disposed in a first plane and the second loop is disposed in a second plane axially spaced relative to the first vertical plane to define an axial gap between the first loop and the second loop.

BRIEF DESCRIPTION OF THE DRAWINGS

Preferred embodiments are disclosed and described in detail herein with reference to the accompanying drawings which form a part hereof, and wherein.

DETAILED DESCRIPTION OF PREFERRED EMBODIMENTS

Figure 1:
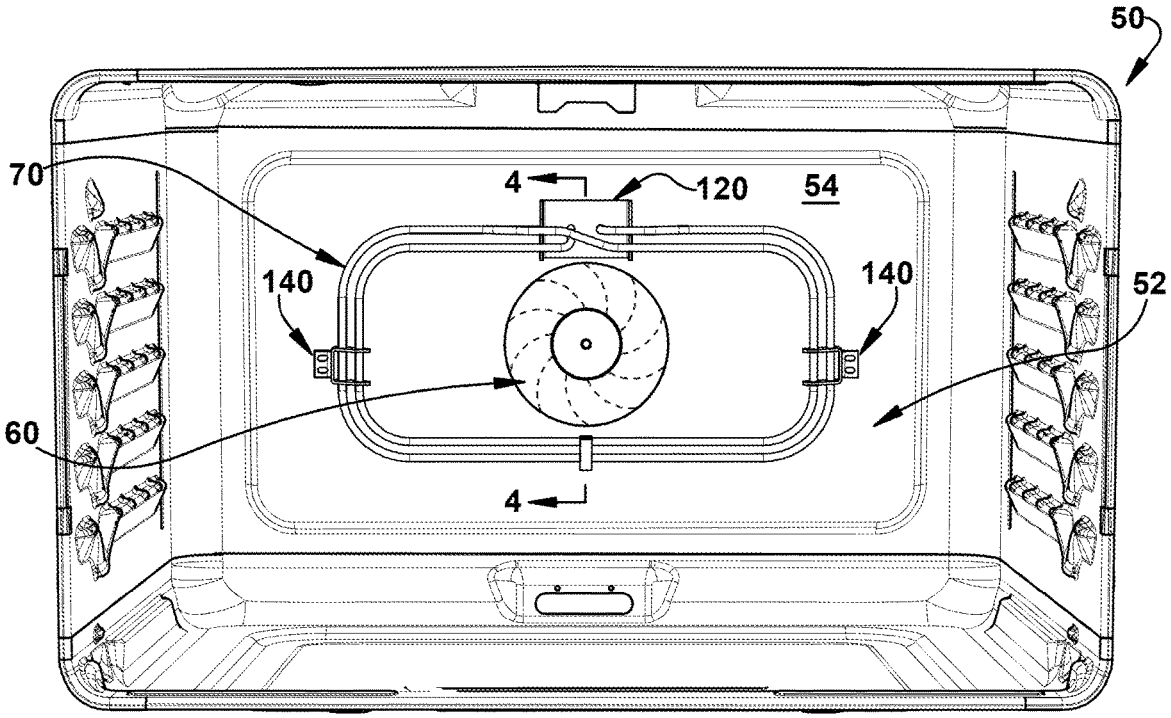
FIG. 1 is a front view of a convection oven cavity having a fan and a heating element disposed at a rear wall of the cavity.

Referring now to the drawings, FIG. 1 shows a front view of an example oven 50 having an interior cavity 52. In the illustrated embodiment, a fan 60 and a convection heating element 70 are mounted at (e.g. adjacent to) a rear wall 54 of the cavity 52. A shroud 62 (FIG. 4), which can be removable, is mounted on the rear wall 54 to enclose the fan 60 and the heating element 70. The shroud 62 is removed from FIG. 1 for illustration clarity.

Figure 2:
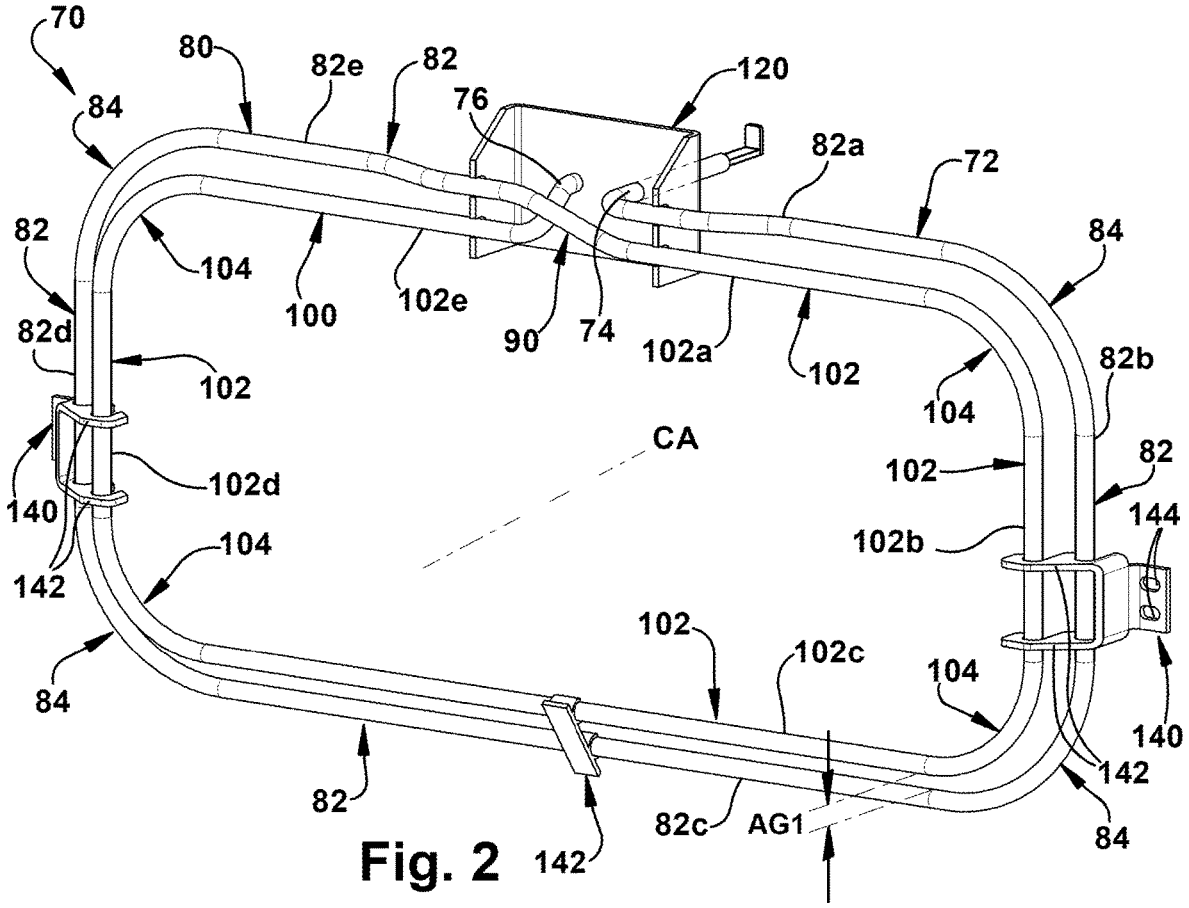
FIG. 2 is a perspective view of an example convection heating element.

Referring to FIG. 2, the heating element 70 is made of a continuous coil 72 having a first end 74 and a second end 76. In the embodiment shown, the coil 72 is shaped to define an outer loop 80 and an inner loop 100. It is contemplated that the coil 72 may embody an encased nickel chromium wire (i.e., Calrod) that is bent to define the outer loop 80 and the inner loop 100. In the embodiment shown, the outer loop 80 and the inner loop 100 are each substantially rectangular and defined by linear segments 82 and 102 that are joined together by curved segments 84 and 104, respectively, in each loop. The loops 80 and 100 may take on other shapes, for example, a circle or an oval, etc. The outer loop 80 and the inner loop 100 are concentrically arranged relative to a common axis CA to define a radial/lateral gap AG1 therebetween when viewed from the front. Specifically, the curved segments 84 and linear segments 82 of the outer loop 80 and the curved segments 104 and linear segments 102 of the inner loop 100 are dimensioned such that the outer loop 80 and the inner loop 100 are concentrically arranged relative to one another, preferably having a constant intermediate radial/lateral gap AG1 therebetween when viewed from the front, along substantially the entire run (or perimeter) of the convection heating element 70.

Figure 3:
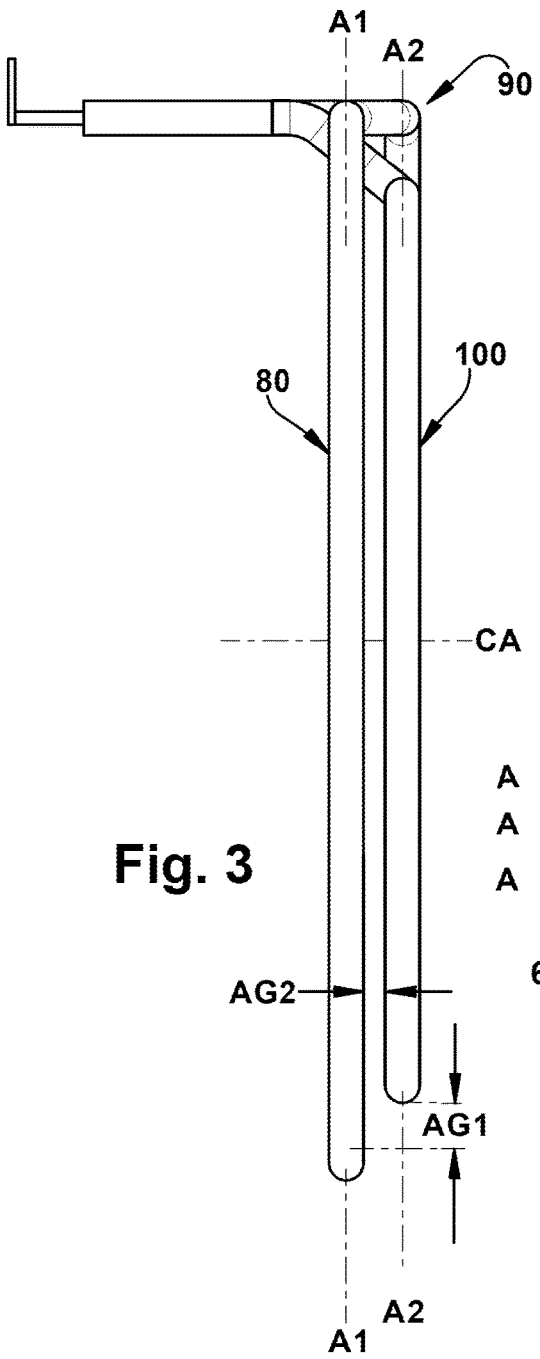
FIG. 3 is a side view of the heating element of FIG. 2.

In the illustrated embodiment, running clockwise (when viewed from the front) the outer loop 80 includes a first top segment 82*a*, a first side segment 82*b*, a bottom segment 82*c*, a second side segment 82*d* opposing the first side segment 82*b*, and a second top segment 82*e*. Similarly, the inner loop 100 includes a first top segment 102*a*, a first side segment 102*b*, a bottom segment 102*c*, a second side segment 102*d* opposing the first side segment 102*b*, and a second top segment 102*e*. A transition segment 90 is formed between the outer loop 80 and the inner loop 100, and specifically between the second top segment 82*e* of the outer loop 80 and the first top segment 102*a* of the inner loop 100 in the illustrated embodiment. As shown in FIGS. 2 and 3, the transition segment 90 is both forwardly and downwardly inclined from an end of the second top segment 82*e* to a beginning of the first top segment 102*a* such that the respective loops 80 and 100 are predominantly disposed in separate, axially spaced planes A1, A2 relative to each other. Typically, planes A1 and A2 will be vertical and substantially parallel to one another and to the rear wall 54 of the cavity 52. In this manner, the inner loop 100 is spaced forwardly relative to the outer loop 80 along the common axis CA to define an axial gap AG2 therebetween. As shown in FIG. 3, the resulting heating element 70 conforms to a generally conical configuration, e.g. when viewed from a side thereof.

As shown in FIGS. 1 and 2, the heating element 70 may be connected to a bracket 120 for mounting the heating element 70 in the cavity 52, and penetrate the bracket 120 so that ends thereof may proceed behind the cavity 52 where they can be connected via terminals to a power source behind the rear wall 54 (not shown).

Figure 4:
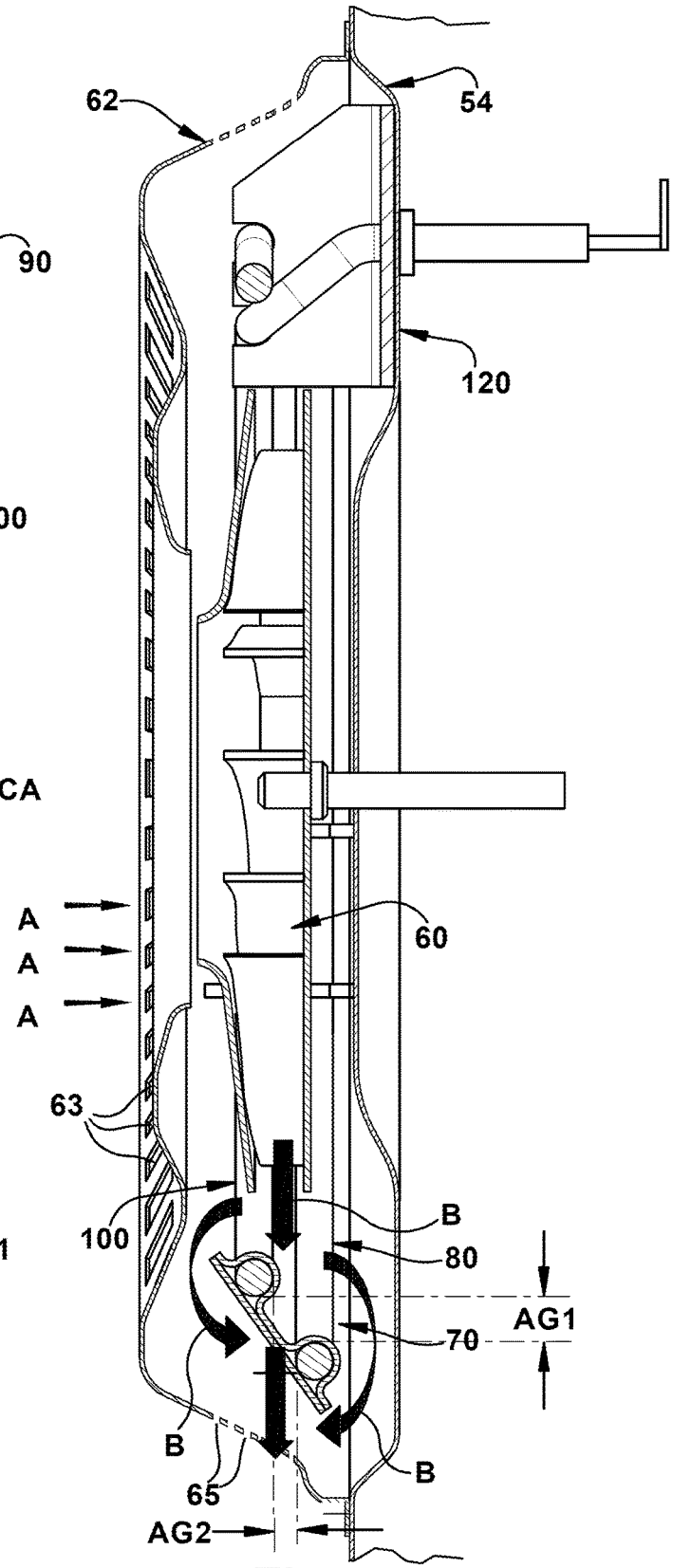
FIG. 4 is a partial, section view of the oven cavity taken along line 4-4 of FIG. 1.

A plurality of brackets 140 may be used to secure the heating element 70 to the rear wall 54 of the cavity 52. Each bracket 140 may include one or more retaining elements 142 that are shaped and dimensioned to accommodate and receive (or affix) the loops 80, 100 therein/thereto. The retaining elements 142 may embody any suitable form for affixing the loops 80, 100 to the brackets 140, for example, but not limited, sleeves, resilient clips, hooks, clamps, and the like. As shown, the brackets 140 have retaining elements 142 in the form of slots dimensioned to accommodate the loops 80, 100 therein, such that when fixed to the rear wall 54 the brackets 140 support the loops 80, 100 in the desired special location relative to that wall 54. When the loops 80, 100 are affixed to the retaining elements 142, fasteners (e.g., screws, bolts, etc.) may be extended through holes 144 (FIG. 2) of the brackets 140 and into preformed holes (not shown) in the rear wall 54 for securing the heating element 70 in the desired special position/orientation adjacent to the rear wall 54. The brackets 140 maintain the structural integrity and spacing of the loops 80, 100, and particularly the spatial integrity of the gaps AG1 and AG2 defined between the loops 80, 100. A separate retaining element 142 may be affixed to the bottom segments 82*c*, 102*c* of the loops 80, 100 to further preserve the spatial integrity between the loops 80, 100 at the bottom of the convection heating element 70. As shown in FIG. 1, when the convection heating element 70 is mounted, the loops 80, 100 surround the fan 60 adjacent to the rear wall 54. As shown in FIG. 4, a shroud 62 may be mounted on the rear wall 54 to enclose the heating element 70 and the fan 60. A plurality of air-passage openings 63 may be formed in the shroud 62 to facilitate the passage of air between the space enclosed by the shroud and the rest of the cavity 52, as described in detail below.

Referring now to FIGS. 1 and 4, the heating element 70 will now be described with respect to an operation of the same. In operation, a power source (not shown) will generate an electric current that is transmitted to the convection heating element 70 in a conventional manner, resulting in resistive heating of the element 70. As shown in FIG. 4, the fan 60 induces air flow, e.g. drawing in cavity air axially through the shroud 70 (arrows A), and expelling that air radially outward (arrows B), first over the convective outer surfaces of the loops 80, 100 (which heats the air) and then out from radial exit ports 65 in the shroud 62 to circulate within the cavity.

In distinction to a conventional co-planar arrangement, whereby loops are disposed within a common plane (e.g. one surrounding the other), the lateral and axial spacing of the loops 80, 100 as disclosed herein exposes greater arc-length proportions of the respective loops 80, 100 to the convective air flow B passing over the loops 80, 100, thereby enabling the air B to extract a greater amount of radiant heat emitted therefrom. That is, the annular and axial gaps AG1 and AG2 between the loops 80 and 100 efficiently expose the predominant proportion of the heat-emissive surface area of the loops 80, 100 to the air flow B passing by, which now can flow through the aforementioned gaps AG1 and AG2 to access portions of those surfaces that would be un- or less available if the loops 80 and 100 were radially co-planar or if they possessed a common perimeter/diameter, e.g. defining a single cylindrical form. The disclosed configuration wherein the concentric loops 80 and 100 are spaced both axially and radially/laterally enables heat to be transferred more efficiently between those loops 80, 100 and the air flow B passing over the loops 80, 100. In other words, this spacing enables the passing air to contact and extract heat from a greater proportion of the convective outer surfaces of the loops 80, 100, thereby increasing the heat-transfer efficiency of the heating element 70 overall—by increasing the effective heat-transfer rate. Moreover, utilizing a single coil 72 to form the respective loops 80, 100, rather than providing them as two separately powered heating elements, reduces the watt density required to attain comparable heat-transfer. Maintaining a low watt density is particularly beneficial for enabling the use of a smaller diameter coil, which maximizes the gaps AG1 and AG2 defined between the loops 80, 100, and the corresponding convective surface areas of the loops 80, 100. Utilizing a smaller diameter coil design also minimizes the air flow resistance imparted by the loops 80, 100, thereby enabling the use of a lower-power fan to achieve comparable air-flow rates. Moreover, improving the heat-transfer efficiency between the convection heating element 70 and the air flow passing over that element 70 not only saves energy by converting more of the energy generated into cooking energy that is delivered into the cavity 52, but it also reduces the likelihood of enamel cracking or other damage at the rear wall 54 and the shroud 62 by diverting thermal energy that otherwise would be absorbed into the cooking cavity 52 via convection.

Illustrative embodiments have been described, hereinabove. It should be appreciated that features of the embodiments described herein may be combined. Therefore, the inventive concept, in its broader aspects, is not limited to the specific details and representations shown and described. For example, it should be appreciated that the heating elements described herein may be adapted for other types of ovens. It will be apparent to those skilled in the art that the above apparatuses and methods may incorporate changes and modifications without departing from the scope of this disclosure. The invention is therefore not limited to particular details of the disclosed embodiments, but rather encompasses the spirit and the scope thereof as embodied in the appended claims.

What is claimed is:

1. A convection oven comprising:

a cavity defining a cooking space;

a fan mounted adjacent to a rear wall of the cavity; and a heating element mounted adjacent to the rear wall, the heating element comprising:

a first loop and a second loop arranged concentrically relative to a common axis and defining a lateral gap therebetween when viewed along said axis, the first loop being disposed in a first plane and the second loop being disposed in a second plane axially spaced relative to the first plane to define an axial gap between the first loop and the second loop; and a first bracket adapted to receive the loops and to preserve the lateral and axial gaps therebetween, wherein the fan includes a plurality of blades, each blade having a tip with an intermediate portion that overlaps with the axial gap when viewed from the side, such that said blades are configured to drive air flow radially outward through said axial gap in operation of said fan.

2. The convection oven according to claim 1, wherein the heating element comprises a coil that is shaped to define both the first loop and the second loop.

3. The convection oven according to claim 2, said coil further comprising a transition segment formed between the first loop and the second loop, wherein the transition segment is inclined both axially to define the axial gap, and radially, relative to said common axis, to define the lateral gap.

4. The convection oven according to claim 1, said first and second planes both being vertical planes, which also are substantially parallel to a rear wall of an oven cavity in which said heating element is disposed.

5. The convection oven according to claim 1, wherein in use the fan induces air to flow through both the axial gap and the lateral gap, thereby flowing over and extracting heat emitted from predominant arc-length proportions of heat-transfer surfaces of the first loop and the second loop prior to disbursing the air throughout the cavity.

6. The convection oven according to claim 1, wherein the first loop and the second loop are substantially conformal.

7. The convection oven according to claim 1, the heating element further comprising a second bracket defining an opening for receiving a portion of the heating element therethrough.

8. The convection oven according to claim 1, wherein the first bracket includes a retaining element adapted to affix the respective first and second loops thereto.

9. The convection oven according to claim 6, the heating element further comprising a second bracket defining an opening for receiving a portion of the heating element therethrough.

10. The convection oven according to claim 6, wherein the first bracket includes a retaining element adapted to affix the respective first and second loops thereto.

* * * * *